US009986340B2

(12) United States Patent
Liao

(10) Patent No.: US 9,986,340 B2
(45) Date of Patent: May 29, 2018

(54) LOUDSPEAKER

(71) Applicant: Huanbin Liao, Shenzhen (CN)

(72) Inventor: Huanbin Liao, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days. days.

(21) Appl. No.: 15/383,061

(22) Filed: Dec. 19, 2016

(65) Prior Publication Data

US 2018/0007470 A1 Jan. 4, 2018

(30) Foreign Application Priority Data

Jun. 29, 2016 (CN) ..... 2016 2 0664693 U

(51) Int. Cl.

| | |
|---|---|
| ***H04R 1/00*** | (2006.01) |
| ***H04R 9/02*** | (2006.01) |
| ***H04R 9/06*** | (2006.01) |
| ***H04R 7/12*** | (2006.01) |

(52) U.S. Cl.

CPC ..... *H04R 9/025* (2013.01); *H04R 7/127* (2013.01); *H04R 9/06* (2013.01); *H04R 2209/022* (2013.01); *H04R 2499/11* (2013.01)

(58) Field of Classification Search

CPC ..... H04R 9/025; H04R 7/127; H04R 9/06; H04R 2209/022; H04R 2499/11

USPC ..... 381/314

See application file for complete search history.

(56) References Cited

U.S. PATENT DOCUMENTS

2013/0016874 A1* 1/2013 Huang ..... H04R 9/043 381/433

2014/0056464 A1* 2/2014 Li ..... H04R 9/025 381/400

* cited by examiner

*Primary Examiner* — Sunita Joshi

(74) *Attorney, Agent, or Firm* — Na Xu; IPro, PLLC

(57) ABSTRACT

A loudspeaker is disclosed. The loudspeaker includes a magnetic circuit system including a first magnetic part, a second magnetic part surrounding the first magnetic part, and a magnetic gap formed by the first and second magnetic parts. At least one of the first and second magnetic parts is a magnet. The first magnetic part includes a body and an avoiding part formed surrounding an edge of the body.

9 Claims, 10 Drawing Sheets

LOUDSPEAKER

FIELD OF THE INVENTION

The invention relates to the technical field of loudspeakers, and more particularly to a miniature loudspeaker used in a portable device.

DESCRIPTION OF RELATED ART

With the coming of mobile internet times, the quantity of intelligent mobile device is rising continuously. Among many mobile equipment, mobile phone is the most common and portable mobile terminal equipment. At present, the function of mobile phone is diversified. One of important functions is that of high quality music. The loudspeaker in mobile phone is one of the essential conditions of realizing the function of high quality music.

The loudspeaker of the related technology includes a vibration system and a magnetic circuit system driving the vibration system. The vibration system includes a membrane and dome with a center hole. The membrane is facing to the magnetic circuit system. The dome is set fixedly on one side of the membrane that is away from the magnetic circuit system and covers the center hole. The magnetic circuit system includes pole plate. The pole plate includes the upper surface set by facing to the membrane, the lower surface opposite to the upper surface and the avoiding part formed by depressing from the upper surface to the lower surface. Orthographic projection of the membrane on the pole plate exceeds the scope of the avoiding part.

In order to guarantee the effective vibration of the membrane, the spacing between the membrane and the avoiding part and the spacing between the dome and the upper surface are larger than that between the membrane and the upper surface, which will cause the waste of space.

Therefore, it is necessary to provide an improved loudspeaker to overcome above disadvantage.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Figure 1:
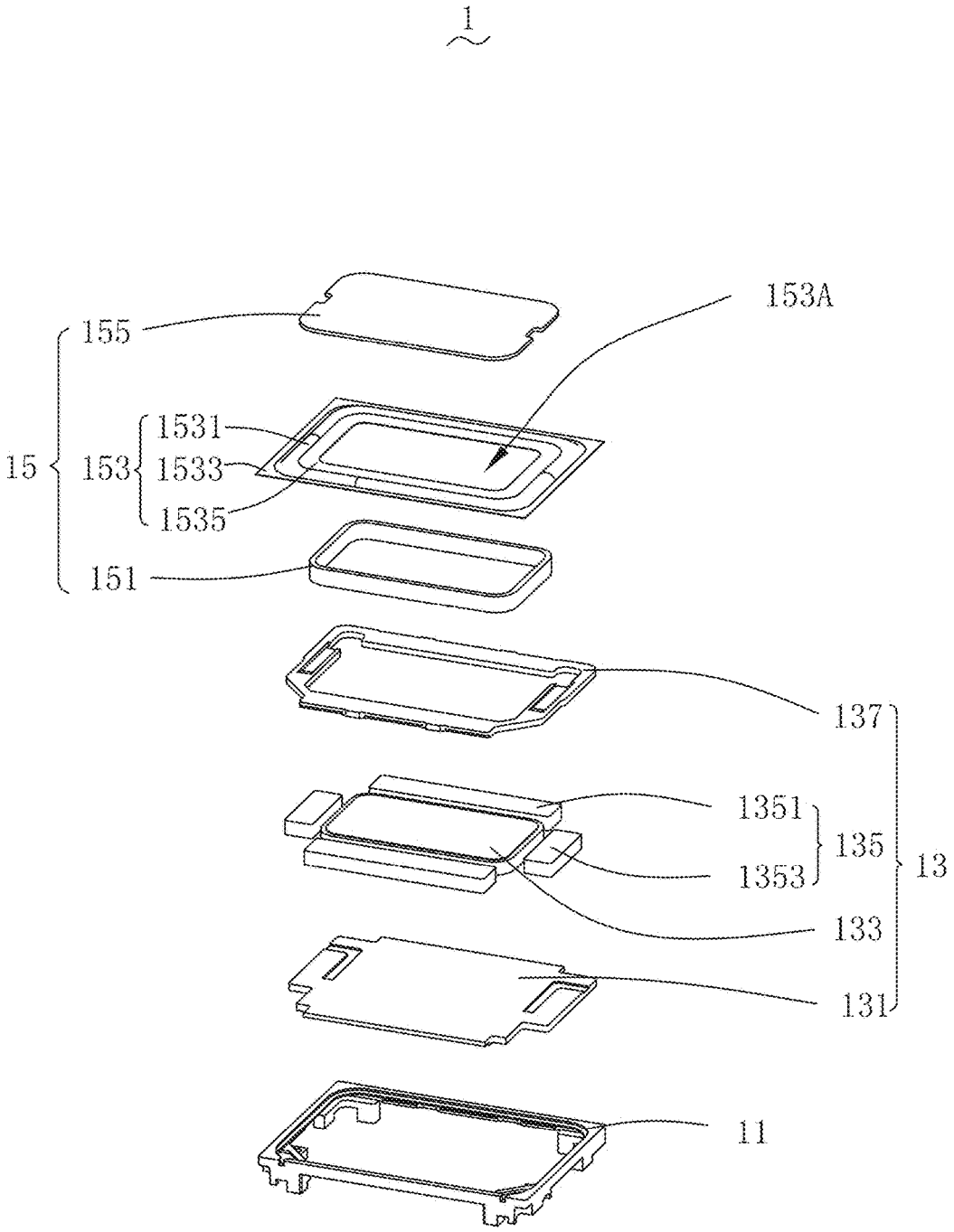
FIG. 1 is an isometric and exploded view of a loudspeaker in accordance with a first embodiment of the present disclosure.
Figure 2:
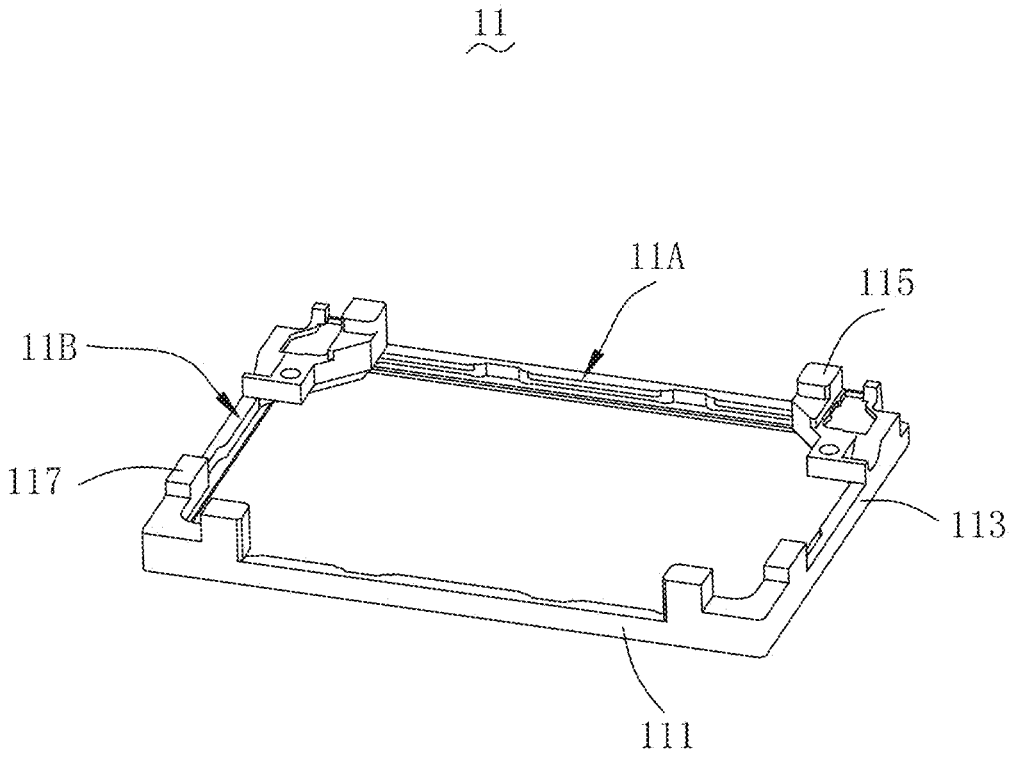
FIG. 2 is an isometric view of a frame of the loudspeaker.
Figure 3:
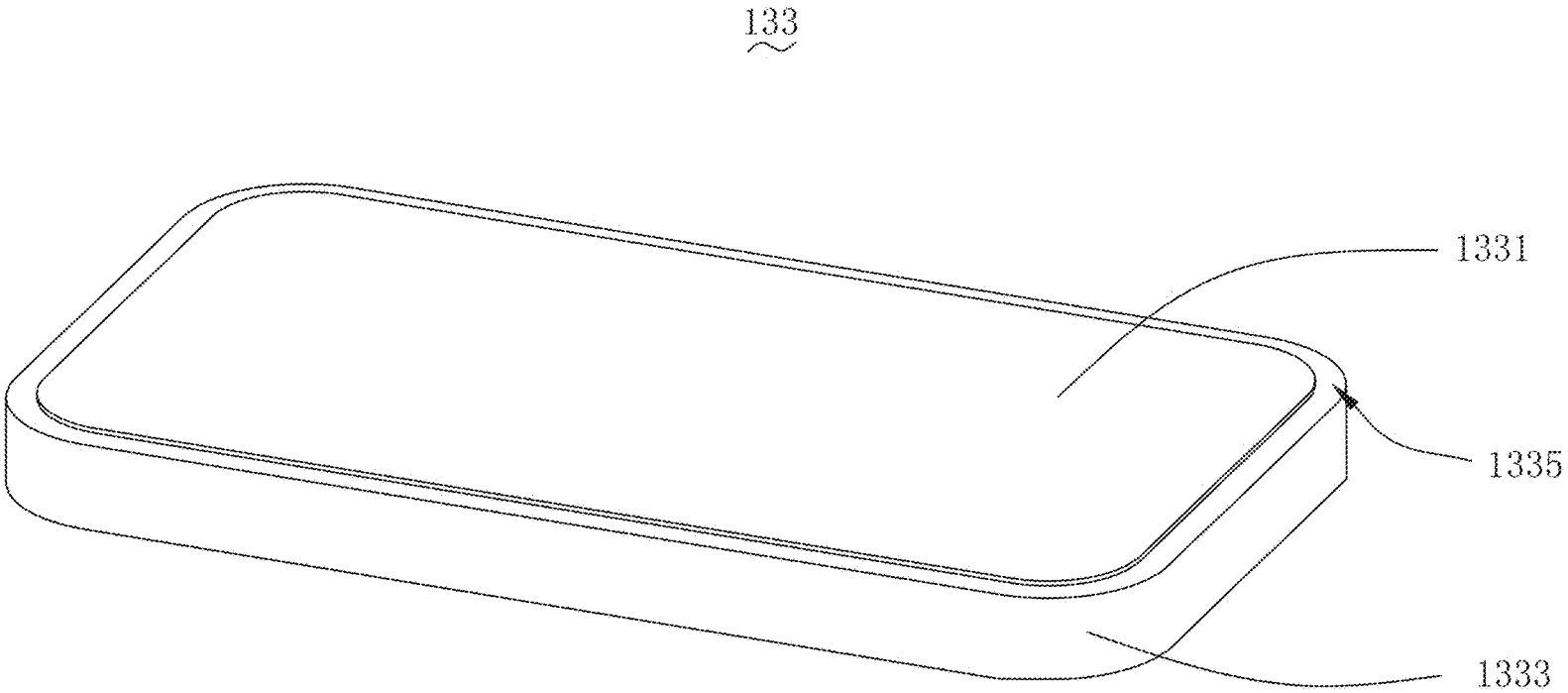
FIG. 3 is an isometric view of a first magnetic part of the loudspeaker.
Figure 4:
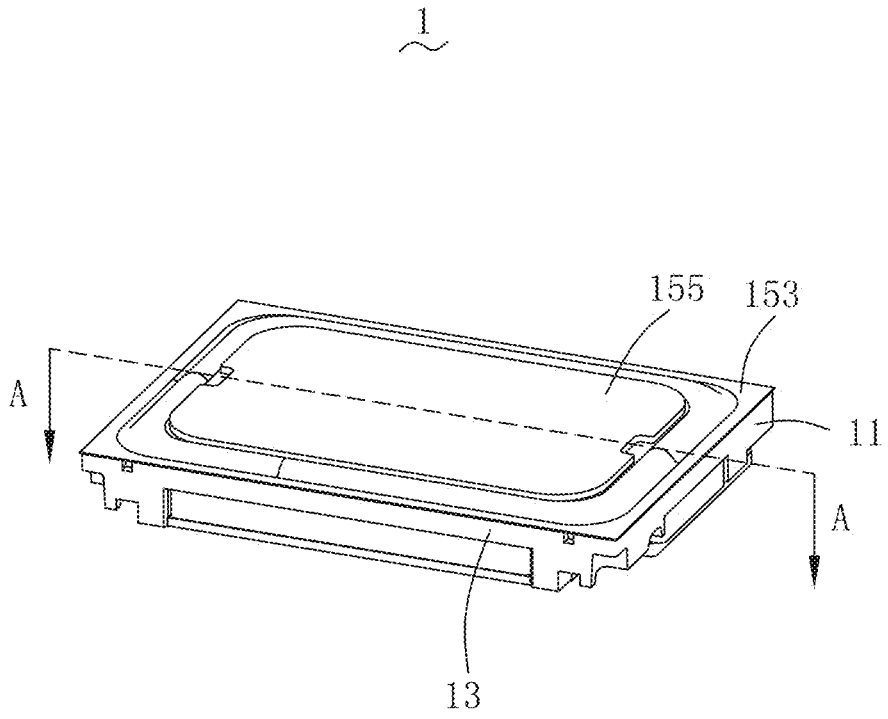
FIG. 4 is an isometric and assembled view of the loudspeaker.
Figure 5:
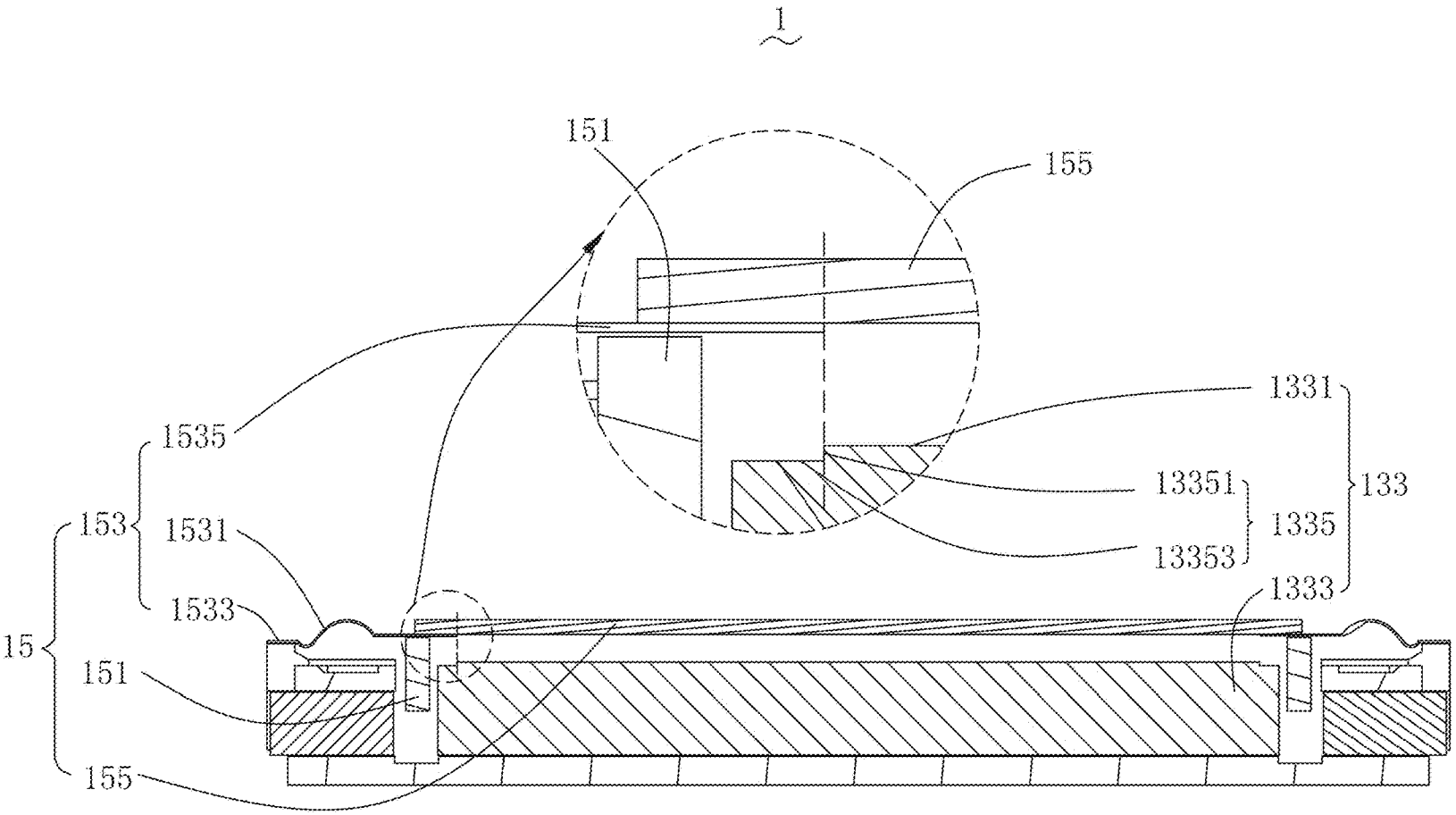
FIG. 5 is a cross-sectional view of the first magnetic part taken along line A-A of FIG. 3.

The present invention will hereinafter be described in detail with reference to exemplary embodiments. To make the technical problems to be solved, technical solutions and beneficial effects of present disclosure more apparent, the present disclosure is described in further detail together with the figures and the embodiments. It should be understood the specific embodiments described hereby is only to explain this disclosure, not intended to limit this disclosure.

Embodiment 1

Referring to FIGS. 1-5, a loudspeaker 1 includes a frame 11 with an accommodation space, a magnetic circuit system 13 accommodated inside the frame 11 and a vibration system 15 fixed and held in the frame 11.

The whole frame 11 is a hollow rectangle. The frame 11 includes two side walls of long axis 111, two side walls of short axis 113, blocks 115 set on two ends of the walls of long axis 111 and fixation arms 117 set on two ends of the walls of short axis 113. Two side walls of long axis 111 are connected with two side walls of short axis 113. The block 115 and the walls of long axis 111 form the first accommodation part 11A. The fixation arm 117 and the walls of short axis 113 form the second accommodation part 11B.

The first accommodation part 11A and the second accommodation part 11*b* accommodate the magnetic circuit system 13 partially.

The magnetic circuit system 13 includes a lower clamping plate 131, a first magnetic part 133, a second magnetic part 135 and an upper clamping plate 137. The lower clamping plate 131 is the plate fixed and held on the frame 11 and after the lower clamping plate 131 is fixed and held on the frame 11, the block 115 is located inside the lower clamping plate 131. The first magnetic part 133 and the second magnetic part 135 are attached and set on the lower clamping plate 131. The second magnetic part 135 set around the first magnetic part 133 and forms the magnetic gap with the first magnetic part 133. The upper clamping plate 137 is fixed and held on the frame 11 and stacks on the second magnetic part 135. The upper clamping plate 137 has through-hole. Part of the first magnetic part 133 is located inside the through-hole of the upper clamping plate 137.

The whole first magnetic part 133 is rectangular structure. The first magnetic part 133 includes a body 1333 and an avoiding part 1335 formed on the body 1333. The avoiding part 1335 is located on the edge of the body 1333 and surround the body 1333. The body 1333 includes an upper surface 1331 facing the vibration system 15, and a lower surface facing the upper surface 1331. The avoiding part is formed by depressing from the upper surface 1331 to the lower surface. After being assembled, the lower surface is attached to the lower clamping plate 131 directly. The upper surface 1331 is at the same horizontal plane with the surface of the upper clamping plate 137's one side away from the second magnetic part 135, and the avoiding part 1335 is located in the through-hole of the upper clamping plate 137.

The body 1333 is magnet. Among the embodiment, the magnet is one whole magnet in the rectangular shape.

The avoiding part 1335 includes a retaining wall 13351 extending from the upper surface 1331 to the direction of the lower surface and the avoiding side 13353 extending from the retaining wall 13351 to outer side of the body 1333.

The second magnetic part 135 is an auxiliary magnet, which includes a first auxiliary magnet 1351 set on the edges of two long axis of the body 1333 and a second auxiliary magnet 1353 set on the edges of two short axis of the body 1333. The first auxiliary magnet 1351 is accommodated in the first accommodation part 11A. The auxiliary magnet 1353 is accommodated in the second accommodation part 11B.

The vibration system 15 includes a voice coil 151, a membrane 153 and a dome 155. One end of the voice coil 151 is inserted to a magnetic gap formed by the first magnetic part 133 and the second magnetic part 135, and the other end is connected fixedly with the membrane 153. The membrane 153 faces to the upper surface 1331. The membrane has a center hole 153A. The dome 155 is connected fixedly on the surface of the voice coil 153's one side away from the upper surface 1331 of the first magnetic part 133. The dome covers the cut center hold 153A. When the voice coil 151 is electrified, the voice coil 151 will vibrate under the effect of magnetic field of the magnetic circuit system 13. At the same time, the voice coil 151 will drive the membrane 153 to vibrate together.

The membrane 153 includes a suspension 1531, a fixation part 1533 formed by extending outward from the suspension 1531 and a joint part 1535 formed by extending inward from the suspension 1531. The joint part 1535 encloses the center hole 153A.

The fixation part 1533 is fixed and connected on the frame 11.

The joint part 1535 is connected with the voice coil 151 and the dome 155 fixedly respectively. Specifically, the voice coil 151 is fixed and connected on the surface of the joint part 1535 close to the upper surface 1331 of the first magnetic part 133. The dome 155 is connected fixedly on the surface of the joint part 1535 away from the upper surface 1331 of the first magnetic part 133. The dome covers the center hole 153A.

The center hole 153A is enclosed by a contour line of the joint part 1535. The orthographic projection of the contour line on the first magnetic part 133 is located within the scope of the contour of the avoiding side 1335 of the avoiding part 1335. In order to meet the above conditions, the extended size of the joint part 1535 can be reduced and that of the avoiding side 13353 can be increased. Among the embodiment, preferably, the extended size of the joint part 1535 shall be reduced. The center hole 153A is enclosed by contour line of the joint part 1535. The orthographic projection of the contour line on the first magnetic part 133 overlaps with the connection line between the retaining wall 13351 and the avoiding side 13353 of the avoiding part 1335. The Spacing between the joint part 1535 and the avoiding side 13353 is equal to that between the dome 155 and the upper surface 1331 of the membrane 153 to guarantee the efficient vibration space of the membrane 15 while utilize the remained space to add the whole thickness of the magnetic circuit system 13 to improve the magnetic flux of magnetic circuit, so the sensitivity of the loudspeaker is improved.

Embodiment 2

Figure 6:
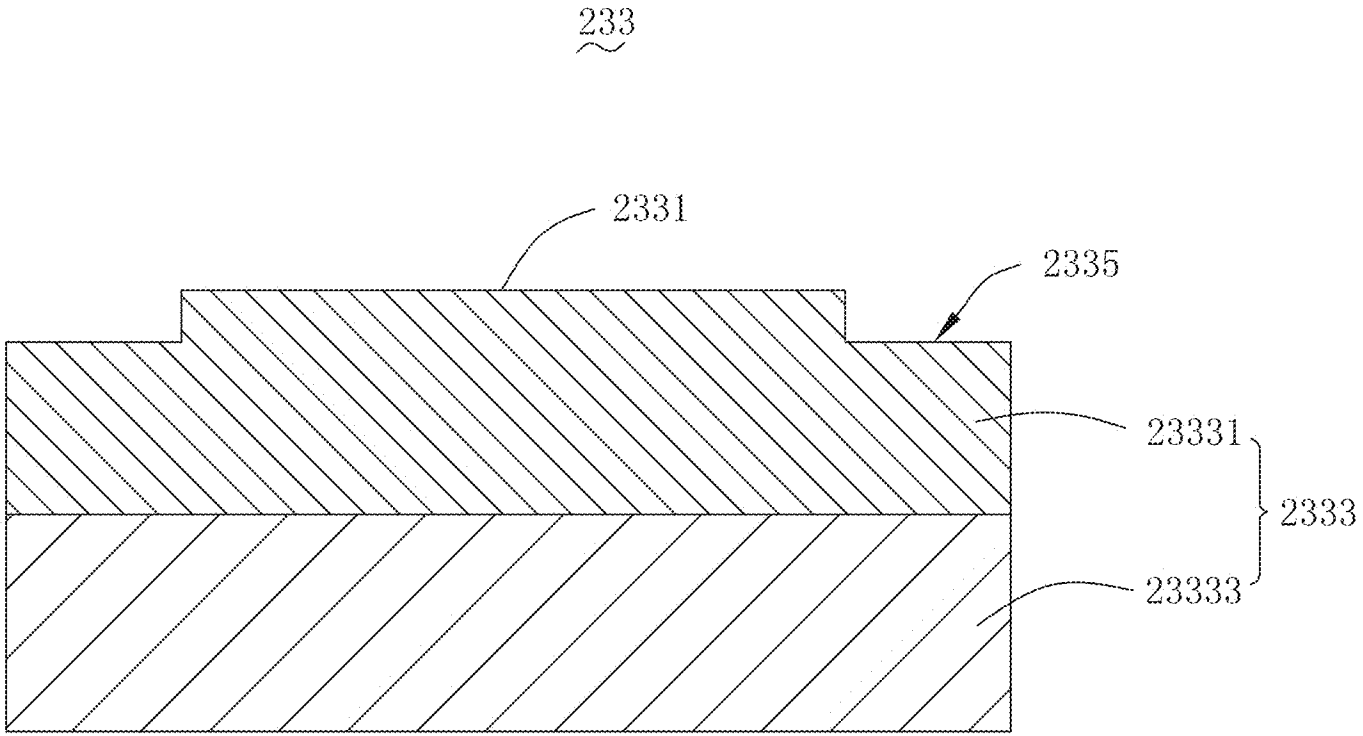
FIG. 6 is a cross-sectional view of a first magnetic part in accordance with a second exemplary embodiment of the present disclosure.

Referring to FIG. 6, the first magnetic part 233 includes a body 2333 and an avoiding part 2335 formed on the body 2333. The body 2333 includes an upper surface 2331, a lower surface opposite to the upper surface 2331, and an avoiding part 2335 is formed by depressing from the upper surface 2331 to the lower surface. The structure of the upper surface 2331, lower surface and the avoiding part 2335 is the same as that of the corresponding parts in the embodiment 1. The positions of the upper surface 2331, the lower surface, the avoiding part 2335 and the body 2333 are the same as that of the corresponding parts in the embodiment 1. Specifically, the body 2333 is magnet and the magnet is split structure, which includes the first magnet 23331 and the second magnet 23333 set opposite to the polarity of the first magnet 23331. The upper surface 2331 is one surface of the first magnet 233311. The second magnet 23333 is stacked on the surface of the first magnet 23331's one side away from the upper surface 2331. The lower surface is the surface of the second magnet 23333's one side away from the first magnet 23331. The avoiding part 2335 is formed by the upper surface 2331 depressing to the lower surface instead of penetrating the first magnet 23331.

Embodiment 3

Figure 7:
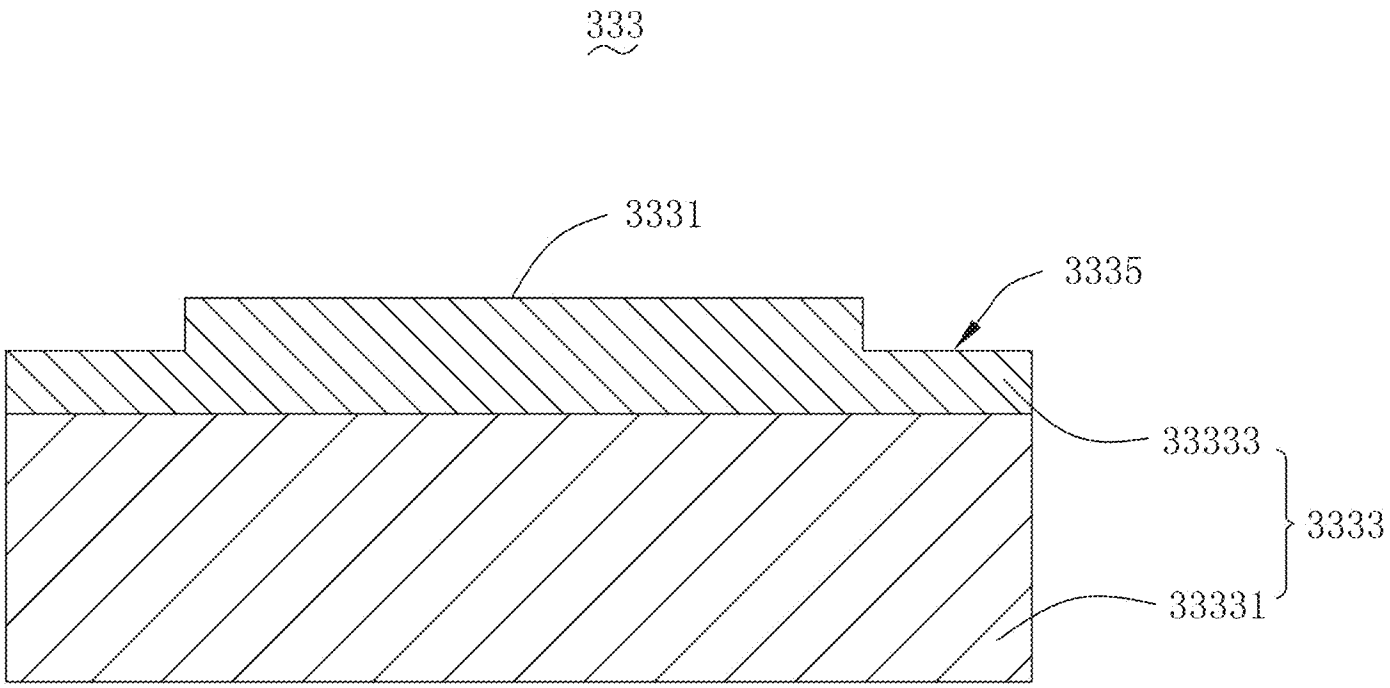
FIG. 7 is a cross-sectional view of a first magnetic part in accordance with a third exemplary embodiment of the present disclosure.

Referring to FIG. 7, the first magnetic part 333 includes a body 3333 and an avoiding part 3335 formed on the body 3333. The body 3333 includes an upper surface 3331, a lower surface opposite to the upper surface 3331. The avoiding part 3335 is formed by depressing from the upper surface 3331 to the lower surface. The structure of the upper surface 3331, the lower surface and the avoiding part 3335 is the same as that of the corresponding parts in the embodiment 1, and the setting positions of the upper surface 3331, the lower surface, the avoiding part 3335 and the body 3333 is the same as that of the corresponding parts in the embodiment 1, but the structure of the body 3333 is different from that of corresponding body in the embodiment 1. Specifically, the body 3333 includes magnet 33331 and pole plate 33333. The upper surface 2331 is one surface of the pole plate 33333. The magnet 23331 is stacked on the surface of the pole plate 33333's one side opposite to the upper surface 3331. The lower surface is the surface of the magnet 33331's one side away from the pole plate 33333. The avoiding part 3335 is formed by the upper surface 3331 depressing to the lower surface instead of penetrating the pole plate 33333.

Embodiment 4

Figure 8:
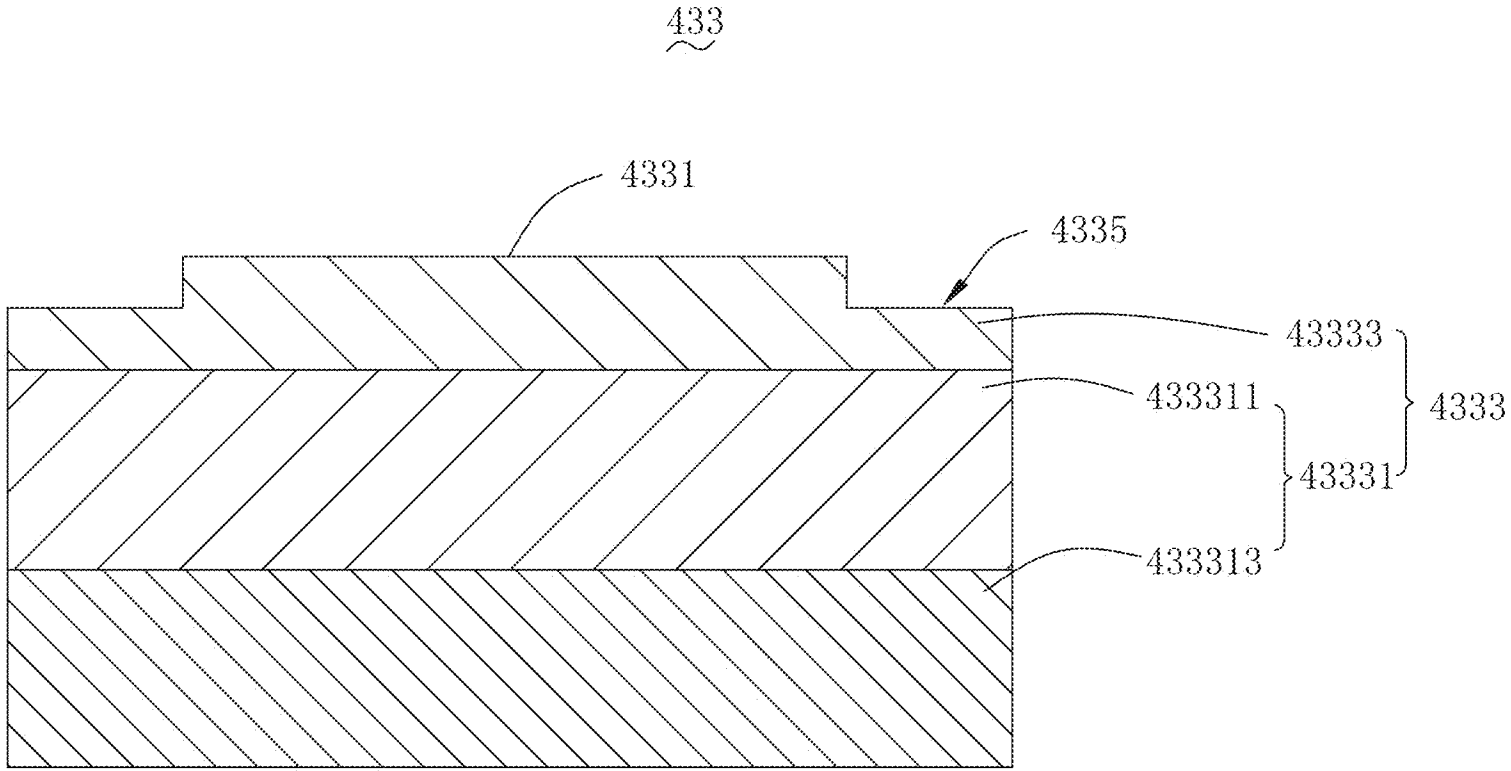
FIG. 8 is a cross-sectional view of a first magnetic part in accordance with a fourth exemplary embodiment of the present disclosure.

Referring to FIG. 8, the first magnetic part 433 includes a body 4333 and an avoiding part 4335 formed on the body 4333. The body 4333 includes an upper surface 4331, a lower surface opposite to the upper surface 4331. The avoiding part 4335 is formed by depressing the upper surface 4331 to the lower surface. The body 4333 includes a magnet 43331 and a pole plate 43333. The structure of the upper surface 4331, the lower surface, the avoiding part 4335 and the pole plate 43333 is the same as that of corresponding parts in the embodiment 3 and the setting of positions of the upper surface 4331, the lower surface, the avoiding part 4335, the magnet 43331 and the pole plate 43333 is the same as that of the corresponding parts in the embodiment 3, but the structure of the magnet 43331 is different from that of corresponding magnet in the embodiment 3. Specifically, The magnet includes the first magnet 433311 and the second magnet 433313, they are both stacked and set in order on the surface of the pole plate 43333's one side opposite to the upper surface 4331, and the setting of polarity of the first magnet 433311 is opposite to that of the second magnet 433313. The lower surface is the surface of the second magnet 433313's one side away from the first magnet 433311.

Embodiment 5

Figure 9:
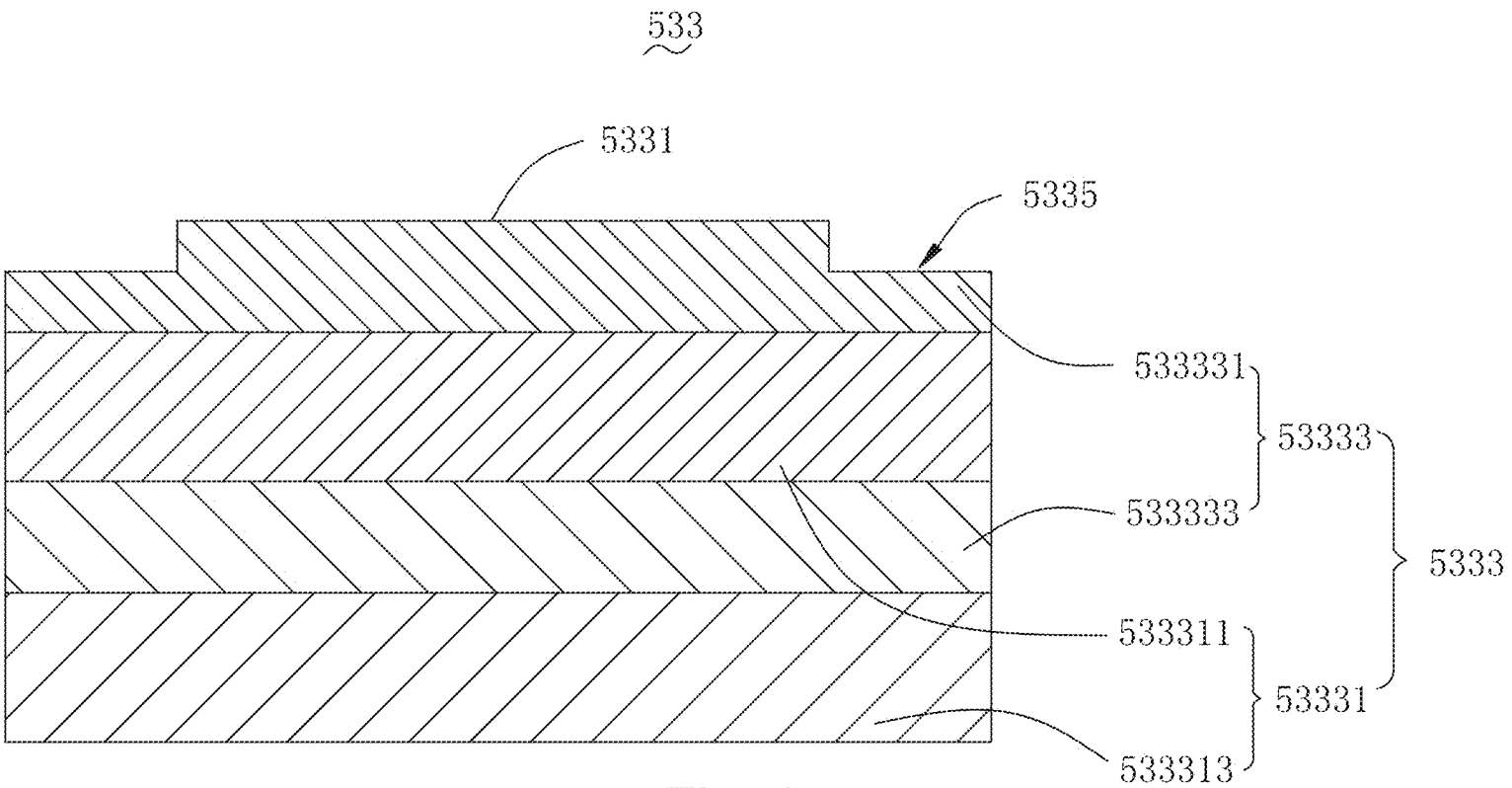
FIG. 9 is a cross-sectional view of a first magnetic part in accordance with a fifth exemplary embodiment of the present disclosure.

Referring to FIG. 9, the first magnetic part 533 includes a body 5333 and an avoiding part 5335 formed on the body 5333. The body 5333 includes an upper surface 5331 and a lower surface opposite to the upper surface 5331. The avoiding part 5335 is formed by depressing from the upper surface 5331 to the lower surface. The structure of the upper surface 5331, the lower surface and the avoiding part 5335 is the same as that of corresponding parts in the embodiment 1, and the setting of the position of the upper surface 5331, the lower surface, the avoiding part 5335 and the body 5333 is the same as that of the corresponding parts in the embodiment 1, but the structure of the body 5333 is different from that of the corresponding body in the embodiment 1. Specifically, the body 5333 includes magnet 53331 and pole plate 53333. The magnet 53331 includes the first magnet 533311 and the second magnet 533313 set oppositely with the polarity of the first magnet 533311. The pole plate 53333 includes a first pole plate 533331 and a second pole plate 533333. The upper surface 5331 is the one surface of the first pole plate 533331. The first magnet 533311, the second pole plate 533333 and the second magnet 533313 are stacked in order on the surface of the first pole plate 533331's one side opposite to the upper surface 5331. The lower surface is the surface of the second magnet 533313's one side away from the first magnet 533311. The avoiding part 5335 is formed by the upper surface 5331 depressing to the lower surface instead of penetrating the first pole plate 53331.

Embodiment 6

Figure 10:
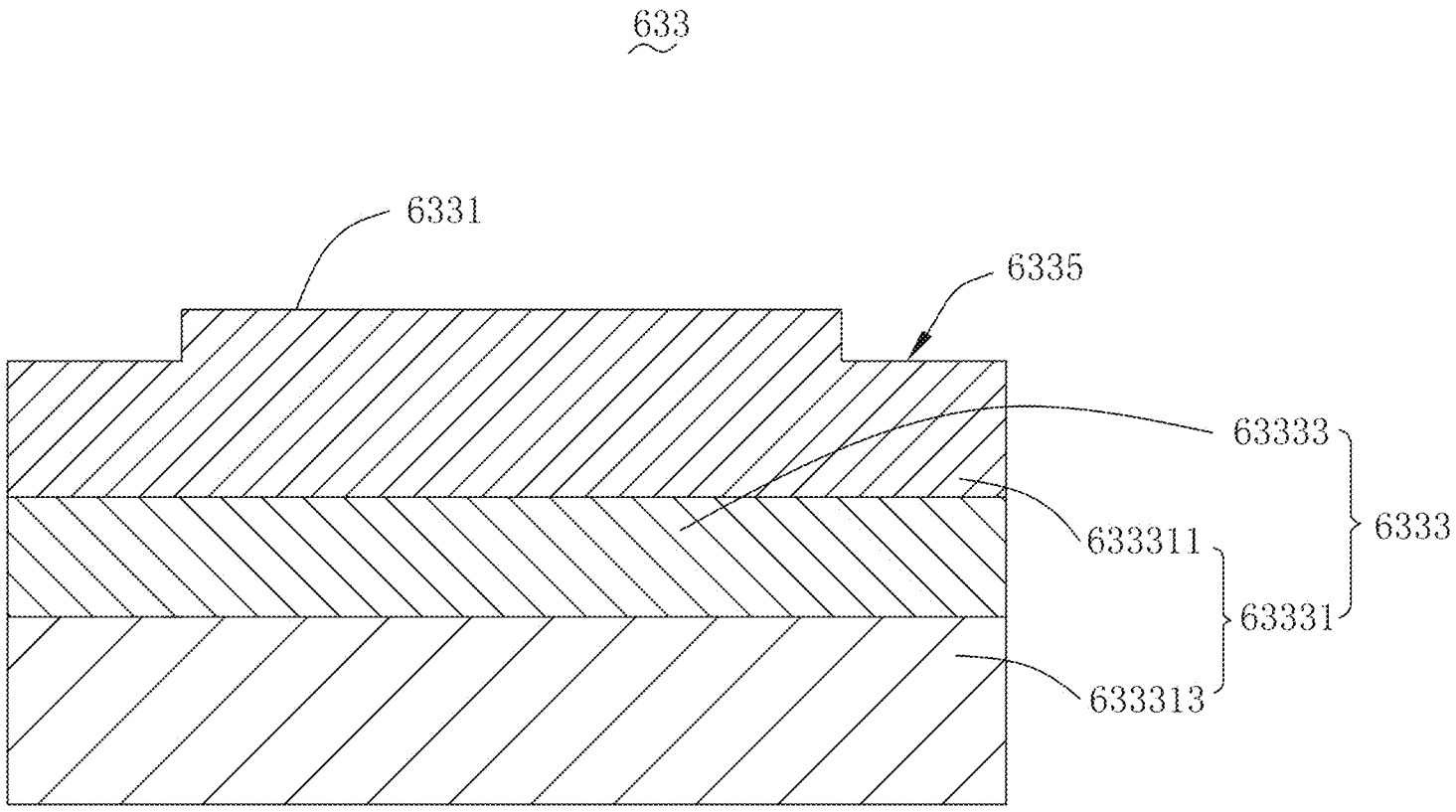
FIG. 10 is a cross-sectional view of a first magnetic part in accordance with a sixth exemplary embodiment of the present disclosure.

Referring to FIG. 10, the first magnetic part 633 includes a body 6333 and an avoiding part 6335 formed on the body 6333. The body 6333 includes upper surface 6331, and lower surface opposite to the upper surface 6331. The avoiding part 6335 is formed by depressing from the upper surface 6331 to the lower surface. The structure of the upper surface 6331, the lower surface and the avoiding part 6335 is the same as that of corresponding component in the embodiment. The setting of the positions of the upper surface 6331, the lower surface, the avoiding part 6335 and the body 6333 is the same as that the corresponding parts in the embodiment 1, but the structure of the body 6333 is different from that of the corresponding body in the embodiment 1. Specifically, the body 6333 includes a magnet 63331 and a pole plate 63333. The magnet 633311 includes the first magnet 633311 and the second magnet 633313 set oppositely with polarity of the first magnet 633311. The upper surface 6331 is one surface of the first magnet 633311. The pole plate 63333 and the second magnet 633313 are stacked in order on the surface of the first magnet 633311's one side opposite to the upper surface 6331. The lower surface is the surface of the second magnet 633313's one side away from the first magnet 633311. The avoiding part 6335 is formed by depressing from the upper surface 6331 to the lower surface instead of penetrating the first magnet 633311.

In any of embodiment 2, embodiment 4, embodiment 5, embodiment 6, the polarity of the first magnet and the second magnet can be set according to the setting way of N-S-S-N and the way of S-N-N-S as well.

By reducing the extended size of the joint part or increasing the extended size of the avoiding side, the loudspeaker provided in this utility model causes that: The orthographic projection of the joint part's edge away from the suspension on the first magnetic part is located within the scope of the contour of the avoiding side of the avoiding part. The remained space is used for increasing the whole thickness of the magnetic circuit system so as to increase the magnetic flux of the magnetic circuit. The sensitivity of the loudspeaker can be improved without influencing the distortion and high order of the loudspeaker.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A loudspeaker, comprising:

a magnetic circuit system including a first magnetic part, a second magnetic part surrounding the first magnetic part, and a magnetic gap formed by the first and second magnetic parts, at least one of the first and second magnetic parts being a magnet, the first magnetic part including a body and an avoiding part formed surrounding an edge of the body;

a vibration system driven by the magnetic circuit system, and including a dome and a membrane facing the magnetic circuit system, the membrane including a center hole;

a dome fixedly attached to one side of the membrane away from the magnetic circuit system and covering the center hole; wherein the avoiding part includes an upper surface facing to the membrane and a lower surface opposite to the upper surface; the avoiding part is formed by depressing from the upper surface to the lower surface; the center hole is enclosed by a contour line of the membrane; an orthographic projection of the contour line on the first magnetic part is located within the area of the avoiding part, the membrane includes a suspension, a fixation part formed by extending outward from the suspension, a joint part formed by extending inward from the suspension and the center hole is enclosed by the joint part.

2. The loudspeaker as described in claim 1, wherein the avoiding part includes a retaining wall extending from the upper surface to the lower surface and an avoiding side extending from the retaining wall to outer side of the first magnetic part; the center hole is enclosed by a contour line of the joint part, and the orthographic projection of the contour line on the first magnetic part is located within the area of the avoiding side.

3. The loudspeaker as described in claim 2, wherein a spacing between the joint part and the avoiding side is equal to that of the dome and the upper surface.

4. The loudspeaker as described in claim 1, wherein the body is a magnet.

5. The loudspeaker as described in claim 4, wherein the magnet includes a first magnet facing the membrane and a second magnet stacked on the first magnet and opposite to the polarity of the first magnet, and the avoiding part is located on the first magnet.

6. The loudspeaker as described in claim 1, wherein the body includes a pole plate facing the membrane, and the magnet is attached on a surface of the pole away from the membrane, and the avoiding part is located on the pole plate.

7. The loudspeaker as described in claim 6, wherein the magnets includes a first magnet and a second magnet which are both stacked and set in order on the surface of the pole plate's one side away from the membrane, the first magnet is set opposite to the polarity of the second magnet.

8. The loudspeaker as described in claim 1, wherein the body includes a magnet and a pole plate, the magnets includes a first magnet and a second magnet set opposite to the polarity of the first magnet, and the pole plate includes a first pole plate and a second pole plate facing to the membrane; the first magnet and the second pole plate and the second magnet are stacked and set in order on the surface of the pole plate's one side away from the membrane, the avoiding part is located on the first pole plate.

9. The loudspeaker as described in claim 1, wherein the body includes magnets and pole plates; the magnets includes a first magnet set facing to the membrane and a second magnet set opposite to the polarity of the first magnet; the pole plate and the second magnet are stacked and set in order on the surface of the first magnet's one side away from the membrane, the avoiding part is located on the first magnet.

* * * * *